US009792855B2

(12) United States Patent
Seo et al.

(10) Patent No.: US 9,792,855 B2
(45) Date of Patent: Oct. 17, 2017

(54) ORGANIC LIGHT EMITTING DISPLAY APPARATUS HAVING REDUCED EFFECT OF PARASITIC CAPACITANCE

(71) Applicant: SAMSUNG DISPLAY CO., LTD., Yongin, Gyeonggi-Do (KR)

(72) Inventors: Myeonghee Seo, Yongin (KR); Junwon Choi, Yongin (KR); Minkyu Woo, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 9 days.

(21) Appl. No.: 14/791,660

(22) Filed: Jul. 6, 2015

(65) Prior Publication Data

US 2016/0189609 A1 Jun. 30, 2016

(30) Foreign Application Priority Data

Dec. 29, 2014 (KR) ..... 10-2014-0192555

(51) Int. Cl.
*G09G 3/30* (2006.01)
*G09G 3/3233* (2016.01)

(52) U.S. Cl.
CPC ... *G09G 3/3233* (2013.01); *G09G 2300/0426* (2013.01); *G09G 2300/0814* (2013.01); *G09G 2300/0819* (2013.01); *G09G 2300/0842* (2013.01); *G09G 2300/0861* (2013.01); *G09G 2310/0262* (2013.01); *G09G 2310/08* (2013.01)

(58) Field of Classification Search
CPC ..... G09G 3/3233; G09G 2300/0819; G09G 2300/0842; G09G 2310/08; G09G 2300/0426; G09G 2300/0814; G09G 2300/0861; G09G 2310/0262
See application file for complete search history.

(56) References Cited

U.S. PATENT DOCUMENTS 9,129,923 B1 * 9/2015 Han ..... H01L 27/3248
2005/0099328 A1 * 5/2005 Kasai ..... G09G 3/325 341/144
2009/0278770 A1 * 11/2009 Weitbruch ..... G09G 3/3225 345/76

(Continued)

FOREIGN PATENT DOCUMENTS

KR 10-2009-0023653 A 3/2009
KR 10-2013-0091136 A 8/2013

(Continued)

*Primary Examiner* — Kwang-Su Yang
(74) *Attorney, Agent, or Firm* — Lee & Morse P.C.

(57) ABSTRACT

An organic light emitting display apparatus includes first and second pixels on a display region, first and second scan lines connected to the first and second pixels respectively, and a gate driver to output a first scan signal and a second scan signal to the first and second scan lines respectively. The first pixel includes a first pixel circuit and a first organic light emitting diode (OLED). The second pixel includes a second pixel circuit and a second OLED. Each of the first and second pixel circuits includes a driving transistor to output driving current to the anode of a respective one of the first and second OLEDs. The anode of the second OLED at least partially overlaps the gate of a driving transistor of the first pixel circuit.

19 Claims, 5 Drawing Sheets

(56) References Cited

U.S. PATENT DOCUMENTS

| | | | | |
|---|---|---|---|---|
| 2012/0120045 | A1* | 5/2012 | Noguchi | G09G 3/3233 345/211 |
| 2013/0127924 | A1* | 5/2013 | Lee | G09G 3/32 345/690 |
| 2013/0201172 | A1 | 8/2013 | Jeong et al. | |
| 2014/0098078 | A1 | 4/2014 | Jeon et al. | |
| 2014/0198067 | A1 | 7/2014 | Jeon | |

FOREIGN PATENT DOCUMENTS

| | | | |
|---|---|---|---|
| KR | 10-2014-0045150 | A | 4/2014 |
| KR | 10-2014-0092682 | A | 7/2014 |

* cited by examiner

ORGANIC LIGHT EMITTING DISPLAY APPARATUS HAVING REDUCED EFFECT OF PARASITIC CAPACITANCE

CROSS-REFERENCE TO RELATED APPLICATION

Korean Patent Application No. 10-2014-0192555, filed on Dec. 29, 2014, and entitled, "Organic Light Emitting Display Apparatus," is incorporated by reference herein in its entirety.

BACKGROUND

1. Field

One or more embodiments herein relate to an organic light emitting display.

2. Description of the Related Art

Various types of flat displays have been developed to replace heavy and large cathode ray tube displays. Examples include liquid crystal displays, field emission displays, plasma displays, and organic light emitting displays. Organic light emitting displays are light and slim and have wide viewing angles, quick response times, and low power consumption. Also, the pixels of an organic light emitting display are self-emissive and generate light based on a supplied driving current.

In operation, parasitic capacitance may occur between electronic circuits that are near each other. For example, parasitic capacitance may occur when the voltage level of an electrode of one or both circuits changes. This parasitic capacitance may have an adverse affect on display performance.

SUMMARY

In accordance with one or more embodiments, an organic light emitting display apparatus includes first and second pixels on a display region; first and second scan lines connected to the first and second pixels respectively; and a gate driver to output a first scan signal and a second scan signal to the first and second scan lines respectively, wherein the first pixel includes a first pixel circuit and a first organic light emitting diode (OLED) and the second pixel includes a second pixel circuit and a second OLED, wherein each of the first and second pixel circuits includes a driving transistor to output driving current to an anode of a respective one of the first and second OLEDs, and wherein the anode of the second OLED at least partially overlaps a gate of a driving transistor of the first pixel circuit.

The apparatus may include a controller to output a horizontal synchronization signal to the gate driver, wherein the gate driver is to output the first and second scan signals in synchronization with the horizontal synchronization signal, and wherein a scanning time of the first scan signal precedes a scanning time of the second scan signal. The scanning time of the first scan signal may precede the scanning time of the second scan signal by a cycle of the horizontal synchronization signal.

The apparatus may include a first data line commonly connected to the first and second pixels; and a source driver synchronized with the first and second scan signals and to output a data signal to the first data line. Each of the first and second pixel circuits may include a switching transistor to transfer the data signal based on a respective one of the first or second scan signals; and a storage capacitor to charge a voltage corresponding to the transferred data signal, wherein the driving transistor is to output the driving current corresponding to the voltage charged in the storage capacitor to the anode of a respective one of the first or second OLEDs.

Each of the first and second pixel circuits may include a compensation transistor to electrically connect a gate and a drain of the driving transistor based on a respective one of the first or second scan signals; and a gate initialization transistor to transfer an initialization voltage to the gate of the driving transistor based on a respective one of the third or fourth scan signals, wherein a scanning time of the third scan signal precedes a scanning time by the first scan signal, and wherein a scanning time by the fourth scan signal precedes a scanning time by the second scan signal.

The apparatus may include a controller to output a horizontal synchronization signal to the gate driver, wherein the gate driver is to output the first and second scan signals in synchronization with the horizontal synchronization signal, wherein the scanning time of the third scan signal precedes a scanning time of the first scan signal by a cycle of the horizontal synchronization signal, and wherein the scanning time of the fourth scan signal precedes the scanning time of the second scan signal by the cycle of the horizontal synchronization signal.

Each of the first and second pixel circuits may include an operation control transistor to be controlled by an emission control signal, the operation control transistor disposed between a driving voltage line and a source of the driving transistor; and an emission control transistor to be controlled by the emission control signal, the emission control transistor disposed between a drain of the driving transistor and the anode of a respective one of the first or second OLEDs, wherein the operation control transistor and the emission control transistor are to output a driving current generated by the driving transistor to the anode of the respective one of the first or second OLEDs based on the emission control signal.

Each of the first and second pixel circuits may include an anode initialization transistor to transfer the initialization voltage to the anode of the respective one of first or second OLEDs based on a respective one of the first or second scan signals.

A time when a storage capacitor of the first pixel circuit is completely charged may precede a time when the initialization voltage is transferred to the anode of the second OLED by the anode initialization transistor of the second pixel circuit and an emitting time of the second OLED by an emission control transistor of the second pixel circuit.

A voltage level of a gate of a driving transistor of the first pixel circuit may be changed by a first variance according to a change in a voltage level of the anode of the second OLED at a scanning time by the second scan signal, the voltage level of the gate of the driving transistor of the first pixel circuit may be changed by a second variance according to the change in the voltage level of the anode of the second OLED at an emitting time by the emission control signal, and the second variance may be at least partially compensated by the first variance.

The apparatus may include a third pixel on the display region, wherein the third pixel includes a third pixel circuit and a third OLED, wherein the third pixel circuit includes a driving transistor to output a driving current to an anode of the third OLED, and wherein the anode of the third OLED at least partially overlaps a gate of a driving transistor of the second pixel circuit.

The apparatus may include fourth and fifth pixels adjacent to the display region; fourth and fifth scan lines respectively connected to the fourth and fifth pixels; and a second data line commonly connected to the fourth and fifth pixels, wherein the fourth pixel includes a fourth pixel circuit and a fourth OLEDs, wherein the fifth pixel includes a fifth pixel circuit and a fifth OLED, wherein each of the fourth and fifth pixel circuits includes a driving transistor to output a driving current to an anode of a respective one of the fourth or fifth OLEDs, wherein the anode of the fourth OLED is in a different region from gates of the driving transistors of the fourth and fifth pixel circuits in the display region, and wherein the anode of the fifth OLED is in a different region from gates of the driving transistors of the fourth and fifth pixel circuits in the display region.

In accordance with one or more other embodiments, an organic light emitting display apparatus includes first and second pixel regions on a display region; first and second scan lines respectively connected to the first and second pixel regions; and a gate driver to respectively output a first scan signal and a second scan signal to the first and second scan lines, wherein the first pixel region includes a first pixel circuit and first OLED, wherein the second pixel region includes a second pixel circuit and a second OLED, wherein each of the first and second pixel circuits includes a driving transistor, wherein the anode of the first OLED at least partially overlaps a gate of a driving transistor of the first pixel circuit, wherein the anode of the second OLED at least partially overlaps the gate of the driving transistor of the second pixel circuit, and wherein the second pixel circuit is to output a driving current to the anode of the first OLED.

The apparatus may include a controller to output a horizontal synchronization signal to the gate driver, wherein the gate driver is to output the first and second scan signals in synchronization with the horizontal synchronization signal, and wherein a scanning time of the first scan signal precedes a scanning time of the second scan signal. The scanning time of the first scan signal may precede the scanning time of the second scan signal by a cycle of the horizontal synchronization signal.

The apparatus may include a first data line commonly connected to the first and second pixels; and a source driver synchronized with the first and second scan signals and to output a data signal to the first data line, wherein each of the first and second pixel circuits includes: a switching transistor to transfer the data signal based on a respective one of the first or second scan signals; and a storage capacitor to charging a voltage corresponding to the transferred data signal, wherein the driving transistor is to output the driving current corresponding to the voltage charged in the storage capacitor.

The apparatus may include a controller to output a horizontal synchronization signal to the gate driver, wherein the gate driver is to be synchronized with the horizontal synchronization signal and is to output the first and second scan signals, wherein each of the first and second pixel circuits includes: a compensation transistor to electrically connect a gate and a drain of the driving transistor based on a respective one of the first or second scan signals; and a gate initialization transistor to transfer an initialization voltage to the gate of the driving transistor based on a respective one of the third or fourth scan signals, wherein a scanning time of the third scan signal precedes a scanning time of the first scan signal by a cycle of the horizontal synchronization signal, and wherein a scanning time of the fourth scan signal precedes a scanning time of the second scan signal by the cycle of the horizontal synchronization signal.

Each of the first and second pixel circuits may include an operation control transistor to be controlled by an emission control signal, the operation control transistor disposed between a driving voltage line and a source of the driving transistor; and an emission control transistor to be controlled by the emission control signal, the emission control transistor disposed between a drain of the driving transistor and each of the anodes of the first and second OLEDs, wherein the operation control transistor and the emission control transistor are to output a driving current generated by the driving transistor based on the emission control signal.

The second pixel circuit may include an anode initialization transistor to transfer the initialization voltage to the anode of the first OLED based on the second scan signal, wherein a time when a storage capacitor of the first pixel circuit is completely charged precedes a time when the initialization voltage is transferred to the anode of the first OLED by the anode initialization transistor of the second pixel circuit and an emitting time of the first OLED by the emission control transistor of the second pixel circuit.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
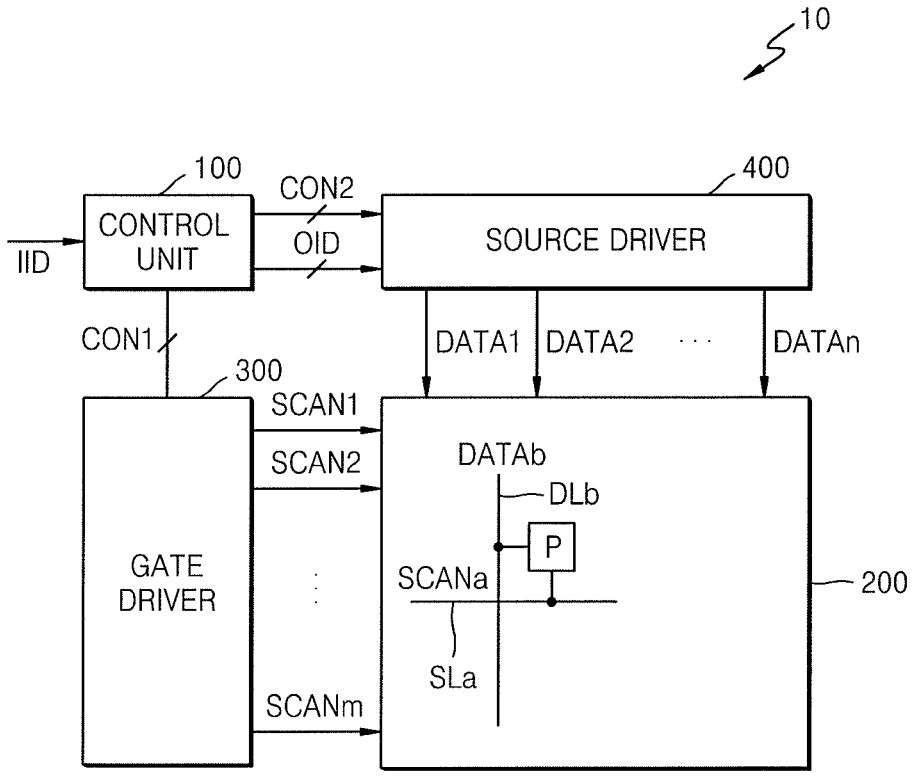
FIG. 1 illustrates an embodiment of an organic light emitting display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of an organic light emitting display apparatus 10, which, for example, may be an electronic apparatus, e.g., a smartphone, a personal computer (PC), a laptop PC, a monitor, or a TV, or an image display component of an electronic apparatus.

The organic light emitting display apparatus 10 includes a control unit 100, a display unit 200, a gate driver 300, and a source driver 400. The control unit 100, the gate driver 300, and the source driver 400 may be formed in separate semiconductor chips or may be integrated in a single semiconductor chip. The control unit 100, the gate driver 300, and/or the source driver 400 may be formed on the same substrate as that on which the display unit 200 is formed, but this is not a necessity.

The organic light emitting display apparatus 10 display images using a plurality of pixels, one example of which is pixel P. More specifically, a unit pixel of the display may include a plurality of sub pixels that emit light of a plurality of respective colors. In one embodiment, pixel P may correspond to a single sub pixel. In another embodiment, the pixel P may correspond to a single unit pixel which includes, for example, a plurality of sub pixels.

The pixel P includes a pixel circuit for controlling a driving current based on received power. The pixel P may include an organic light emitting diode that emits light at a brightness that correspond to the driving current. The pixel circuit outputs the driving current to an anode of the organic light emitting diode based on a voltage of the power and a data signal. The organic light emitting diode emits light corresponding to an amount of current that flows between the anode and a cathode of the organic light emitting diode.

The organic light emitting display apparatus 10 receives a plurality of image frames, for example, from an external source. The image frames may allow a moving image to be displayed when the image frames are sequentially displayed. Each image frame may include input image data IID. The input image data IID may contain information indicative of the luminance of light to be emitted from the pixel P. The number of bits of the input image data IID may be determined based on the number of luminance levels the pixel is capable of emitting.

For example, if the number of luminance levels is 256, the input image data IID may be an 8-bit digital signal. If the darkest value and the brightest value of a grayscale range that may be displayed through the display unit 200 are respectively a first level and a 256th level, the input image data IID corresponding the first level may be 0 and the input image data IID corresponding to the 256th level may be 255. The darkest value of the grayscale range may be referred to as a minimum grayscale value, and the brightest value of the grayscale range may be referred to as a maximum grayscale value. The number of the luminance levels of the light capable of being emitted through the pixel P may be different (e.g., 64, 1024, etc.) in another embodiment.

The control unit 100 is connected to the display unit 200, the gate driver 300, and the source driver 400. The control unit 100 receives input image data IID and outputs first control signals CON1 to the gate driver 300. The first control signals CON1 may include a horizontal synchronization signal HSYNC. The first control signals CON1 may include control signals for the gate driver 300 to output scan signals SCAN1 TO SCANm synchronized with the horizontal synchronization signal HSYNC. The control unit 100 outputs second control signals CON2 to the source driver 400.

The control unit 100 sends output image data OID to the source driver 400. The second control signals CON2 may include control signals for the source driver 400 to output data signals DATA1 to DATAn corresponding to the output image data OID. The output image data OID may include image information for generating the data signals DATA1 to DATAn. The output image data OID may be image data generated by correcting the input image data IID received from the external source.

The display unit 200 includes the plurality of pixels P, a plurality of scan lines, and a plurality of data lines. Each of the data lines is connected to pixels in a column of pixels, and each scan line is connected to pixels in a row of pixels. For example, as illustrated in FIG. 1, the display unit 200 may include pixel P, a first scan line SCANa connected to all pixels of a row in which the pixel P is positioned, and a first data line DATAb connected to all pixels of a column in which the pixel is positioned.

The gate driver 300 outputs the scan signals SCAN1 to SCANm to the scan lines. The gate driver 300 may output the scan signals SCAN1 to SCANm in synchronization with a vertical synchronization signal.

The source driver 400 outputs the data signals DATA1 to DATAn to the data lines in synchronization with the scan signals SCAN1 TO SCANm. The source driver 400 outputs the data signals DATA1 to DATAn proportional to the received image data to the data lines.

Figure 2:
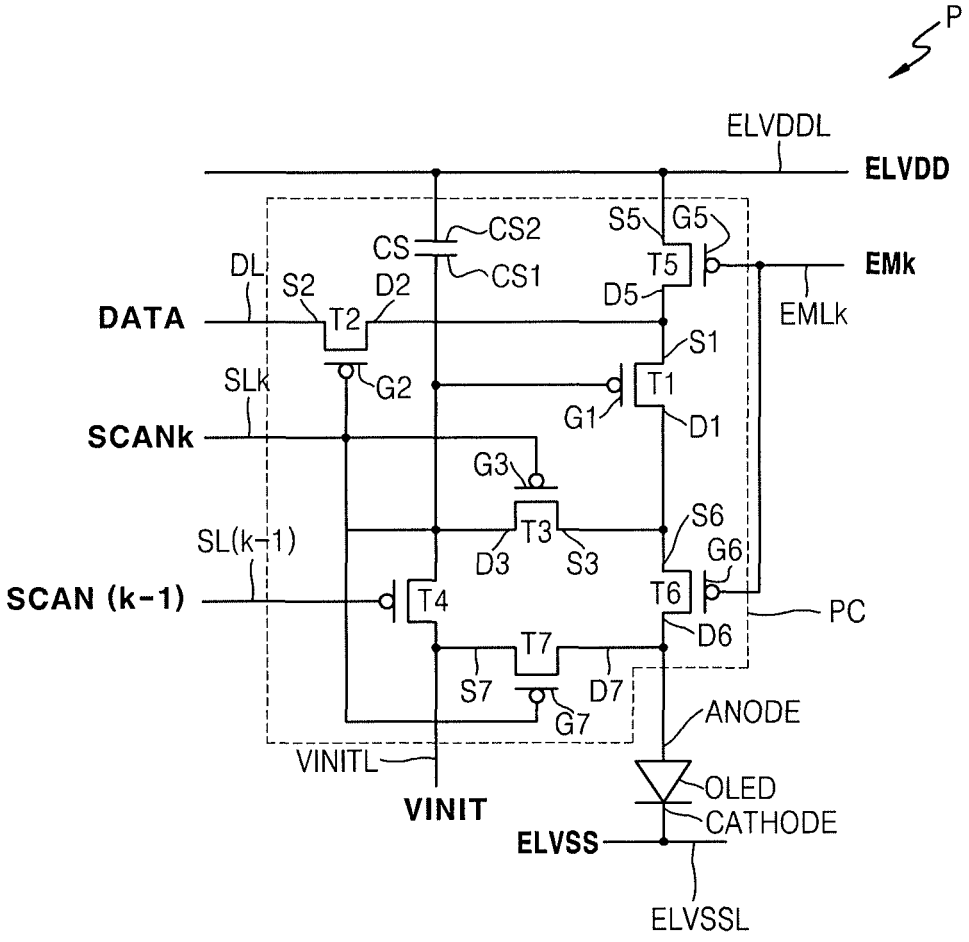
FIG. 2 illustrates an embodiment of a pixel.

FIG. 2 illustrates an embodiment of an equivalent circuit diagram of the pixel P in FIG. 1. Referring to FIG. 2, the pixel P includes a pixel circuit PC and an organic light emitting diode OLED. The pixel circuit PC includes transistors T1, T2, T3, T4, T5, T6, and T7 and a storage capacitor CS. The organic light emitting diode OLED receives driving current from the pixel circuit PC and emits light.

The pixel circuit PC receives various signals and voltages through a first power line ELVDDL which transfers a first power ELVDD, a data line DL which transfers a data signal DATA, a kth scan line SLk which transfers a kth scan signal SCANk, a (k−1)th scan line SL(k−1) which transfers a (k−1)th scan signal SCAN(k−1), an initialization voltage line VINITL which transfers an initialization voltage VINIT, and a kth emission control line EMLk which transfers a kth emission control signal EMk. The pixel circuit PC outputs the driving current to the organic light emitting diode OLED.

The transistors include a driving transistor T1, switching transistor T2, compensation transistor T3, gate initialization transistor T4, operation control transistor T5, emission control transistor T6, and anode initialization transistor T7.

The driving transistor T1 is controlled by a signal applied to its gate electrode G1. The gate electrode G1 of the driving transistor T1 is connected to a first electrode CS1 of the storage capacitor CS. The source electrode S1 of the driving transistor T1 is connected to the first power line ELVDDL via the operation control transistor T5. The drain electrode D1 of the driving transistor T1 is electrically connected to the anode ANODE of the organic light emitting diode OLED via the emission control transistor T6. The driving transistor T1 receives the data signal DATA according to a switching operation and supply the driving current to the organic light emitting diode OLED.

The gate electrode G2 of the switching transistor T2 is connected to the kth scan line SLk. A source electrode S2 of the switching transistor T2 is connected to the data line DL. The drain electrode D2 of the switching transistor T2 is connected to the source electrode S1 of the driving transistor T1, and is connected to the first power line ELVDDL via the operation control transistor T5. The switching transistor T2 is turned on according to the kth scan signal SCANk received through the kth scan line SLk and performs a switching operation to transfer the data signal DATA from the data line DL to the source electrode S1 of the driving transistor T1.

The gate electrode G3 of the compensation transistor T3 is connected to the kth scan line SLk. The source electrode S3 of the compensation transistor T3 is connected to the drain electrode D1 of the driving transistor T1, and is connected to the anode ANODE of the organic light emitting diode OLED via the emission control transistor T6. The drain electrode D3 of the compensation transistor T3 is commonly connected to the first electrode CS1 of the storage capacitor CS, the drain electrode D4 of the gate initialization transistor T4, and the gate electrode G1 of the driving transistor T1. The compensation transistor T3 is turned on according to the kth scan signal SCANk received through the kth scan line SLk, and connects the gate electrode G1 and the drain electrode D1 of the driving transistor T1 to diode connect the driving transistor T1.

The gate electrode G4 of the gate initialization transistor T4 is connected to the (k−1)th scan line SL(k−1). The source electrode S4 of the gate initialization transistor T4 is connected to the initialization voltage line VINITL. The drain electrode D4 of the gate initialization transistor T4 is commonly connected to the first electrode CS1 of the storage capacitor CS, the drain electrode D3 of the compensation transistor T3, and the gate electrode G1 of the driving transistor T1. The gate initialization transistor T4 is turned on, according to the (k−1)th scan signal SCAN(k−1) received through the (k−1)th scan line SL(k−1), to perform an initialization operation to transfer the initialization voltage VINIT to the gate electrode G1 of the driving transistor T1, thereby initializing a voltage of the gate electrode G1 of the driving transistor T1. In this regard, a scanning time by the (k−1)th scan signal SCAN(k−1) may precede a scanning time by the kth scan signal SCANk. Furthermore, the scanning time by the (k−1)th scan signal SCAN(k−1) may precede by a cycle of the horizontal synchronization signal HSYNC the scanning time by the kth scan signal SCANk.

The gate electrode G5 of the operation control transistor T5 is connected to the kth emission control line EMLk. The source electrode S5 of the operation control transistor T5 is connected to the first power line ELVDDL. The drain electrode D5 of the operation control transistor T5 is commonly connected to the source electrode S1 of the driving transistor T1 and the drain electrode D2 of the switching transistor T2.

The gate electrode G6 of the emission control transistor T6 is connected to the kth emission control line EMLk. The source electrode S6 of the emission control transistor T6 is connected to the source electrode S1 of the driving transistor T1 and the source electrode S3 of the compensation transistor T3. The drain electrode D6 of the emission control transistor T6 is connected to the anode ANODE of the organic light emitting diode OLED. The operation control transistor T5 and the emission control transistor T6 are simultaneously turned on, according to the kth emission control signal EMk transferred through the kth emission control line EMLk, to allow the driving current generated by the driving transistor T to flow in the organic light emitting diode OLED.

The gate electrode G7 of the anode initialization transistor T7 is connected to the kth scan line SLk. The source electrode S7 of the anode initialization transistor T7 is connected to the initialization voltage line VINITL. The drain electrode D7 of the anode initialization transistor T7 is commonly connected to the anode ANODE of the organic light emitting diode OLED and the drain electrode D6 of the emission control transistor T6. The anode initialization transistor T7 is turned on, according to the kth scan signal SCANk received through the kth scan line SLk, to perform an initialization operation to transfers the initialization voltage VINIT to the anode ANODE of the organic light emitting diode OLED, thereby initializing a voltage of the anode ANODE of the organic light emitting diode OLED.

The second electrode CS2 of the storage capacitor CS is connected to the first power line ELVDDL. The first electrode CS1 of the storage capacitor CS is commonly connected to the gate electrode G1 of the driving transistor T1, the drain electrode D3 of the compensation transistor T3, and the drain electrode D4 of the anode initialization transistor T7.

The cathode CATHODE of the organic light emitting diode OLED is connected to a second voltage line ELVSSL. The organic light emitting diode OLED receives the driving current supplied by the driving transistor T1 to emit light. The light emitted from the organic light emitting diodes OLEDs of the pixels P form an image.

A process for operating the pixel P will now be described. During an initialization period, the low level (k−1)th scan signal SCAN(k−1) is supplied through the (k−1)th scan line SL(k−1). The gate initialization transistor T4 is turned on in correspondence with the low level (k−1)th scan signal SCAN(k−1). The initialization voltage VINIT is supplied to the gate electrode G1 of the driving transistor T1 from the initialization voltage line VINITL. The driving transistor T1 is initialized by the initialization voltage VINIT.

Thereafter, during a data programming period, the low level kth scan signal SCANk is supplied through the kth scan line SLk. The switching transistor T2, the compensation transistor T3, and the anode initialization transistor T7 are turned on in correspondence to the low level kth scan signal SCANk. In this regard, the driving transistor T1 is placed in a diode-connected state to the compensation transistor T3 that is turned on and is biased in a forward direction. A compensation voltage, that is reduced by a threshold voltage of the driving transistor T1 in the data signal DATA supplied through the data line DL, is applied to the first electrode CS1 of the storage capacitor CS. The initialization voltage VINIT is supplied to the anode ANODE of the organic light emitting diode OLED from the initialization voltage line VINITL through the anode initialization transistor T7. The anode ANODE of the organic light emitting diode OLED is initialized by the initialization voltage VINIT. The driving voltage ELVDD and a compensation voltage is applied to respective ends of the storage capacitor CS. A charge corresponding to the voltage difference of the ends may be changed in the storage capacitor CS.

Thereafter, the kth emission control signal EMk supplied from the kth emission control line EMLk during an emission period changes from a high level to a low level. The operation control transistor T5 and the emission control transistor T6 is turned on by the low level kth emission control signal EMk during the emission period. A driving current corresponding to a voltage difference between a voltage of the gate electrode G1 of the driving transistor T1 and a voltage of the driving voltage ELVDD is generated and supplied to the organic light emitting diode OLED through the emission control transistor T6.

During the emission period, a gate-source voltage of the driving transistor T1 may be maintained as a value of ELVDD-DATA+Vth by the storage capacitor CS. According to a current-voltage relationship of the driving transistor T1, the driving current may be proportional to the square, e.g., (ELVDD-Dm)2, of a value by subtracting the threshold voltage from the gate-source voltage, e.g., ELVDD-DATA+Vth. Thus, the driving current may be determined irrespective of the threshold voltage of the driving transistor T1.

During the process of operating the pixel P, a voltage of the anode ANODE of the organic light emitting diode OLED may be changed. For example, when the kth scan signal SCANk is changed from a high level to a low level, the anode initialization transistor T7 may be turned on. Accordingly, the initialization voltage VINIT is applied to the anode ANODE of the organic light emitting diode OLED. Thus, the anode ANODE of the organic light emitting diode OLED may be changed.

In another example, when the kth emission control signal EMk is changed from a high level to a low level, the operation control transistor 15 and the emission control transistor T6 may be turned on. Accordingly, the driving current may be supplied to the anode ANODE of the organic light emitting diode OLED. Thus, the anode ANODE of the organic light emitting diode OLED may be changed. In this regard, the voltage of a device disposed at a distance close to the anode ANODE of the organic light emitting diode OLED may be changed according to a parasitic capacitance.

For example, the anode ANODE of the organic light emitting diode OLED and the gate electrode G1 of the driving transistor T1 at least partially overlap each other. In this case, the voltage level of the gate electrode G1 of the driving transistor T1 may be changed due to a change in the voltage level of the anode ANODE of the organic light emitting diode OLED. However, when the kth scan signal SCANk is changed from the high level to the low level, since an operation of charging the charge in the storage capacitor CS is performed, the voltage level of the gate electrode G1 of the driving transistor T1 may not be influenced by a change in the voltage level due to the parasitic capacitance.

Meanwhile, when the kth emission control signal EMk supplied from the kth emission control line EMLk is changed from the high level to the low level, the voltage level of the gate electrode G1 of the driving transistor T1 may increase due to the parasitic capacitance and in correspondence to an increase rate of the voltage level of the anode ANODE of the organic light emitting diode OLED. As a result, the voltage level of the gate electrode G1 of the driving transistor T1 may be changed and may be different from a voltage level intended by the data signal DATA.

In another example, the anode ANODE of the organic light emitting diode OLED in one pixel and the gate electrode G1 of the driving transistor T1 in another pixel at least partially overlap each other. In this case, two pixels receive the data signal ATA through the same data line DL and may be adjacent to each other, e.g., vertically adjacent. For example, one pixel may receive the data signal DATA in synchronization with the kth scan signal SCANk transferred through the kth scan line SLk, and another pixel may receive the data signal DATA in synchronization with a (k+1)th scan signal SCAN(k+1) transferred through a (k+1)th scan line SL(k+1). An example of a circuit structure in this regard will now be described with reference to FIG. 3.

Figure 3:
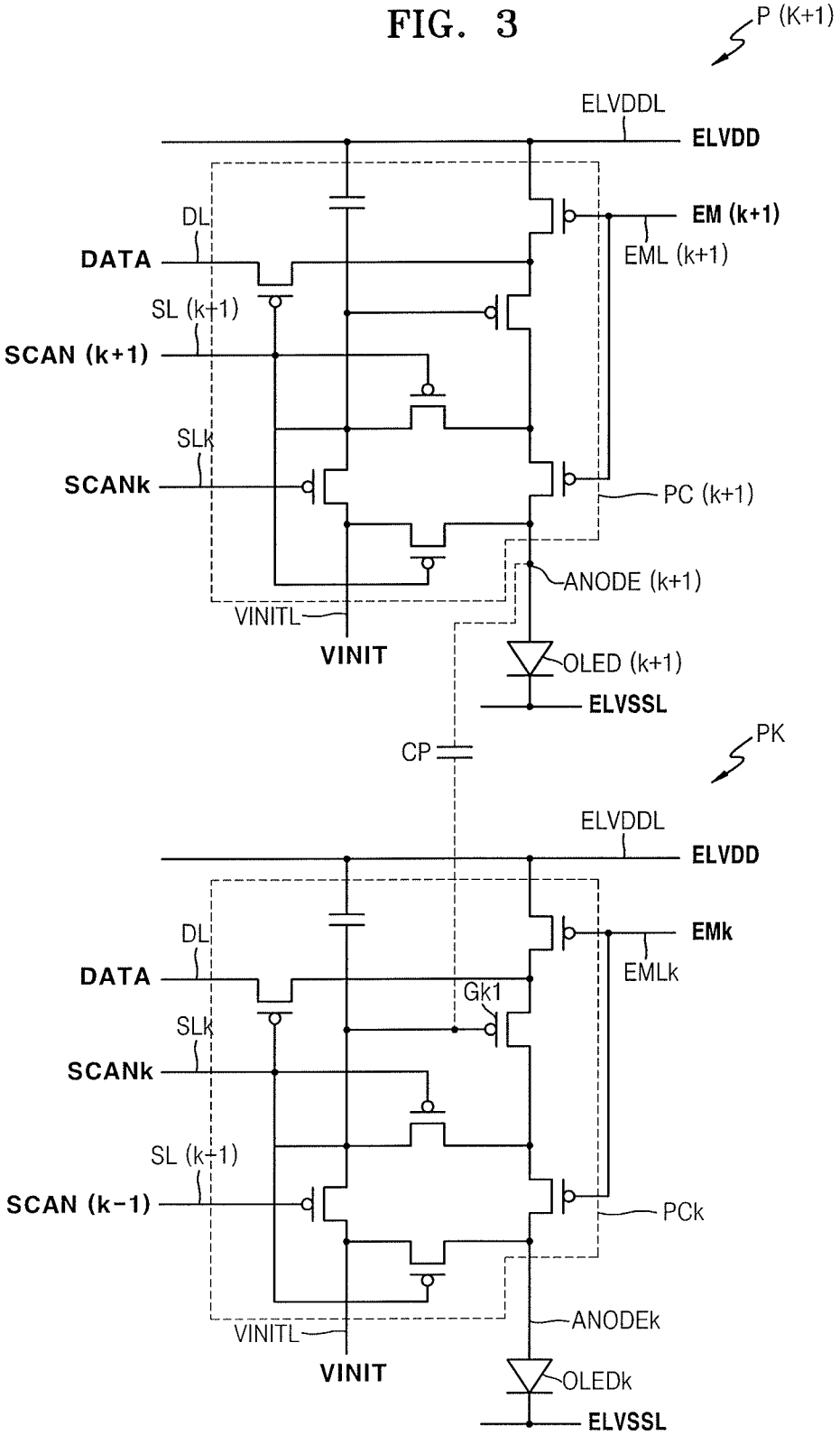
FIG. 3 illustrates an embodiment of adjacent pixels.

FIG. 3 is an equivalent circuit diagram of an embodiment of adjacent pixels, where one of the pixels is the pixel P in FIG. 1 and the other pixel adjacent to pixel P.

Referring to FIG. 3, a kth pixel Pk includes a kth pixel circuit PCk and a kth organic light emitting diode OLEDk. A (k+1)th pixel P(k+1) includes a (k+1)th pixel circuit PC(k+1) and a (k+1)th organic light emitting diode OLED (k+1).

The kth pixel circuit PCk may receive various signals and voltages through the first power line ELVDDL which transfers the first power ELVDD, the data line DL which transfers the data signal DATA, the kth scan line SLk which transfers the kth scan signal SCANk, the (k−1)th scan line SL(k−1) which transfers the (k−1)th scan signal SCAN(k−1), the initialization voltage line VINITL which transfers the initialization voltage VINIT, and the kth emission control line EMLk which transfers the kth emission control signal EMk. The kth pixel circuit PCk outputs a driving current to the kth organic light emitting diode OLEDk.

The (k+1)th pixel circuit PC(k+1) may receive various signals and voltages through the first power line ELVDDL which transfers the first power ELVDD, the data line DL which transfers the data signal DATA, the (k+1)th scan line SL(k+1) which transfers the (k+1)th scan signal SCAN(k+1), the kth scan line SLk which transfers the kth scan signal SCANk, the initialization voltage line VINITL which transfers the initialization voltage VINIT, and a (k+1)th emission control line EML(k+1) which transfers a (k+1)th emission control signal EM(k+1). The (k+1) the pixel circuit PC(k+1) outputs the driving current to a (k+1)th organic light emitting diode OLED(k+1).

In this case, the anode ANODE(k+1) of the (k+1)th organic light emitting diode OLED(k+1) at least partially overlaps the gate electrode Gk1 of a driving transistor Tk1. Accordingly, parasitic capacitance CP may occur between the anode ANODE(k+1) of the (k+1)th organic light emitting diode OLED(k+1) and the driving transistor Tk1 of the kth pixel Pk. As a result, when a voltage level of the anode ANODE(k+1) of the (k+1)th organic light emitting diode OLED(k+1) is changed, a voltage level of the gate electrode Gk1 of the driving transistor Tk1 of the kth pixel Pk may be changed.

FIG. 3 illustrates a case where the kth pixel Pk and the (k+1)th pixel P(k+1) are adjacent to each other. In another embodiment, the scanning time of the kth scan signal SCANk which determines timing for supplying the data signal DATA to the kth pixel Pk precedes the scanning time of the (k+1)th scan signal SCAN(k+1) which determines timing for supplying the data signal DATA to the (k+1)th pixel P(k+1).

An example of the influence of the parasitic capacitance CP that occurs between the gate electrode Gk1 of the driving transistor Tk1 of the kth pixel Pk and the anode ANODE (k+1) of the (k+1)th organic light emitting diode OLED(k+1) will now be described with reference to FIG. 4.

Figure 4:
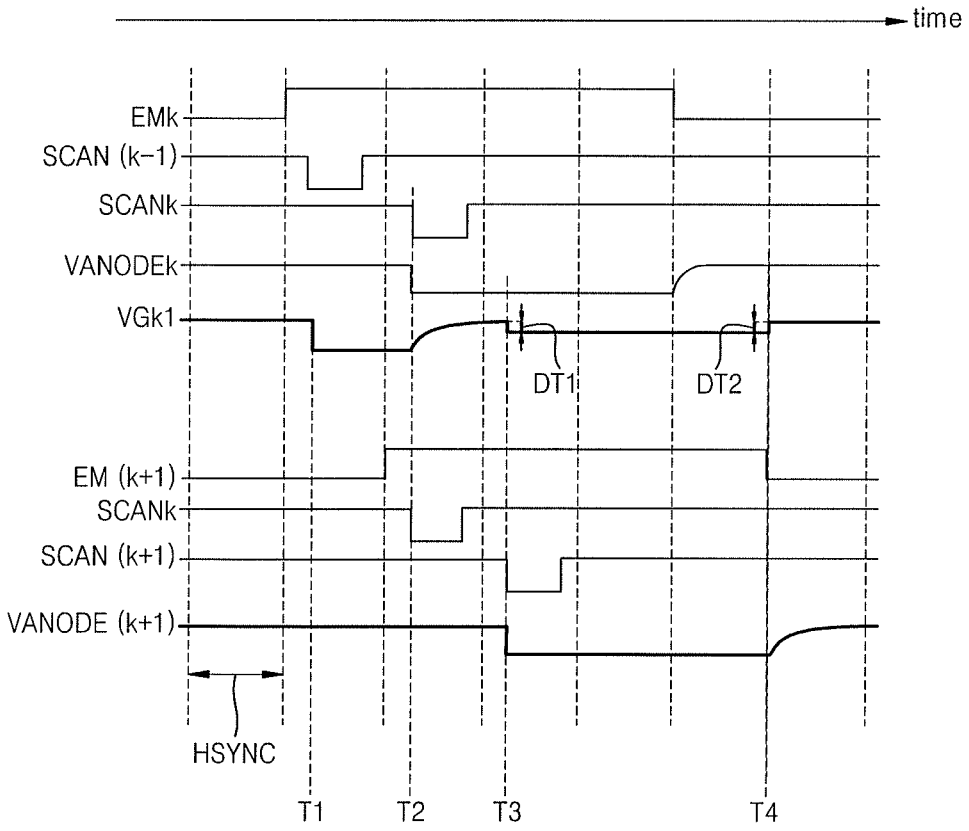
FIG. 4 illustrates an example of the adverse effect of parasitic capacitance.

FIG. 4 is a timing diagram illustrating an example of the adverse influence parasitic capacitance may have on the operation of the kth pixel Pk and the (k+1)th pixel P(k+1) of FIG. 3.

Referring to FIG. 4, the voltage level VGk1 of the gate electrode of a driving transistor of the kth pixel circuit PCk may be determined in synchronization with the (k−1)th scan signal SCAN(k−1) and the kth scan signal SCANk. The voltage level VANODE(k+1) of the anode ANODE(k+1) of the (k+1)th organic light emitting diode OLED(k+1) may be determined in synchronization with the kth scan signal SCANk and the (k+1)th scan signal SCAN(k+1). Due to the parasitic capacitance between the anode ANODE(k+1) of the (k+1)th organic light emitting diode OLED(k+1) and the gate electrode of the driving transistor of the kth pixel circuit PCk, since the voltage level VANODE(k+1) of the anode ANODE(k+1) of the (k+1)th organic light emitting diode OLED(k+1) is changed, the voltage level VGk1 of the gate electrode of the driving transistor of the kth pixel circuit PCk may be changed.

The scanning time of each scan signal may have a gap corresponding to a cycle of the horizontal synchronization signal HSYNC. For example, the scanning time of the (k−1)th scan signal SCAN(k−1) may precede, by a cycle of the horizontal synchronization signal HSYNC, the scanning time by the kth scan signal SCANk. The scanning time by the kth scan signal SCANk may precede, by a cycle of the horizontal synchronization signal HSYNC, the scanning time by the (k+1)th scan signal SCAN(k+1).

At a first time TM1 when the (k−1)th scan signal SCAN (k−1) is changed from a high level to a low level, the voltage level VGk1 of the gate electrode of the driving transistor of the kth pixel circuit PCk may be changed. For example, the voltage level VGk1 of the gate electrode of the driving transistor of the kth pixel circuit PCk may be the same as a level of the initialization voltage VINIT.

At a second time TM2 when the kth scan signal SCANk is changed from the high level to the low level, a voltage of a storage capacitor of the kth pixel circuit PCk may start to be charged. The voltage of the storage capacitor of the kth pixel circuit PCk may charge until the voltage level has a value corresponding to the data signal DATA. When the voltage of the storage capacitor of the kth pixel circuit PCk is charged, the voltage level VGk1 of the gate electrode of the driving transistor of the kth pixel circuit PCk may be changed to the value corresponding to the data signal DATA.

At the second time TM2, a voltage level VANODEk of an anode of a kth organic light emitting diode may be initialized when the initialization voltage VINIT is applied to the anode of the kth organic light emitting diode.

At a third time TM3 when the (k+1)th scan signal SCAN(k+1) is changed from the high level to the low level, the voltage level VANODE(k+1) of the anode ANODE(k+1) of the (k+1)th organic light emitting diode OLED(k+1) may be initialized when the initialization voltage VINIT is applied to the anode ANODE(k+1) of the (k+1)th organic light emitting diode OLED(k+1). In this regard, the voltage level VGk1 of the gate electrode of the driving transistor of the kth pixel circuit PCk may be changed by a first variance DT1 due to the parasitic capacitance between the anode ANODE(k+1) of the (k+1)th organic light emitting diode OLED(k+1) and the gate electrode of the driving transistor of the kth pixel circuit PCk. When the voltage level VANODE(k+1) of the anode ANODE(k+1) of the (k+1)th organic light emitting diode OLED(k+1) is initialized, the voltage level VANODE(k+1) of the anode ANODE(k+1) of the (k+1)th organic light emitting diode OLED(k+1) may be reduced. Accordingly, the voltage level VGk1 of the gate electrode of the driving transistor of the kth pixel circuit PCk may be reduced by the first variance DT1.

At a fourth time TM4 when the (k+1)th emission control signal EM(k+1) is changed from the high level to the low level, a driving current may be applied from the (k+1)th pixel circuit PC(k+1) to the anode of the (k+1)th organic light emitting diode OLED(k+1). Accordingly, the voltage level VANODE(k+1) of the anode ANODE(k+1) of the (k+1)th organic light emitting diode OLED(k+1) may be changed. In this regard, the voltage level VGk1 of the gate electrode of the driving transistor of the kth pixel circuit PCk may be changed by a second variance DT2 due to the parasitic capacitance between the anode ANODE(k+1) of the (k+1)th organic light emitting diode OLED(k+1) and the gate electrode of the driving transistor of the kth pixel circuit PCk. When the driving current is applied to the anode ANODE(k+1) of the (k+1)th organic light emitting diode OLED(k+1), the voltage level VANODE(k+1) of the anode ANODE(k+1) of the (k+1)th organic light emitting diode OLED(k+1) may be increased. Accordingly, the voltage level VGk1 of the gate electrode of the driving transistor of the kth pixel circuit PCk may be reduced by the second variance DT2.

In this case, a change in the voltage level VGk1 of the gate electrode of the driving transistor of the kth pixel circuit PCk that is reduced by the first variance DT1 at the third time TM3 may be at least partially compensated by a change in the voltage level VGk1 of the gate electrode of the driving transistor of the kth pixel circuit PCk that is increased by the second variance DT2 at the fourth time TM4. As a result, the voltage level VGk1 of the gate electrode of the driving transistor of the kth pixel circuit PCk may be very slightly changed or may not be changed at all.

For example, in a first case, the anode ANODE(k+1) of the (k+1)th organic light emitting diode OLED(k+1) at least partially overlaps the gate electrode of the driving transistor of the kth pixel circuit PCk. In a second case, the anode ANODEk of the kth organic light emitting diode OLEDk at least partially overlaps the gate electrode of the driving transistor of the kth pixel circuit PCk. The change in the voltage level VGk1 of the gate electrode of the driving transistor of the kth pixel circuit PCk in the first case may be smaller than the change in the voltage level VGk1 of the gate electrode of the driving transistor of the kth pixel circuit PCk in the second case. As a result, the voltage level VGk1 of the gate electrode of the driving transistor of the kth pixel circuit PCk in the first case may be a better approximation of the voltage level intended by the data signal DATA than the voltage level VGk1 of the gate electrode of the driving transistor of the kth pixel circuit PCk in the second case.

Figure 5:
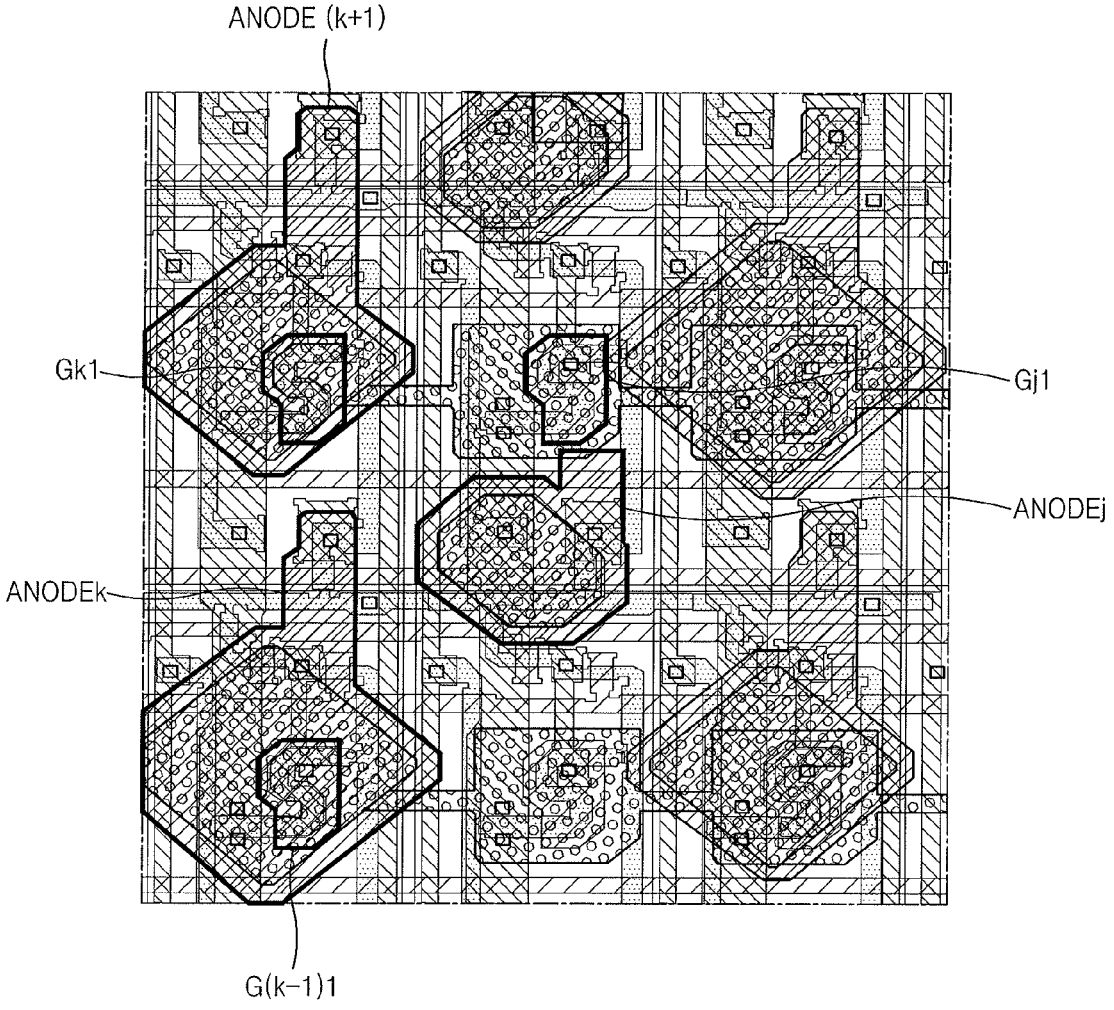
FIG. 5 illustrates another embodiment of adjacent pixels.

FIG. 5 illustrates an plan view of an embodiment of adjacent pixels in FIG. 1. Referring to FIG. 5, the kth pixel Pk includes the anode ANODEk of the kth organic light emitting diode OLEDk and the gate electrode Gk1 of the driving transistor Tk1 of the kth pixel Pk.

As shown in FIG. 5, the anode ANODE(k+1) of the (k+1)th organic light emitting diode OLED(k+1) overlaps the gate electrode Gk1 of the driving transistor Tk1 of the kth pixel Pk. For example, although the anode ANODE(k+1) of the (k+1)th organic light emitting diode OLED(k+1) is driven by a driving current output from the (k+1)th pixel circuit PC(k+1), the anode ANODE(k+1) of the (k+1)th organic light emitting diode OLED(k+1) may be closer to the gate electrode Gk1 of the driving transistor Tk1 of the kth pixel Pk than a gate electrode G(k+1)1 of a driving transistor of the (k+1)th pixel circuit PC(k+1). Likewise, the anode ANODEk of the kth organic light emitting diode OLEDk may overlap a gate electrode G(k−1)1 of a driving transistor of a (k−1)th pixel circuit PC(k−1).

As shown in FIG. 5, in the organic light emitting display apparatus 10, a jth pixel may include an anode ANODEj of a jth organic light emitting diode and a gate electrode Gj1 of a driving transistor of a jth pixel circuit. In this regard, the anode ANODEj of the jth organic light emitting diode may be in a different region from that of the gate electrode Gj1 of the driving transistor of the jth pixel circuit.

Furthermore, the anode ANODEj of the jth organic light emitting diode may be in a different region from those of the gate electrode Gj1 of the driving transistor of the jth pixel circuit and a gate electrode G(j+1)1 of a driving transistor of a j(j+1)th pixel circuit. An anode ANODE(j+1) of the (j+1)th organic light emitting diode may be in a different region from those of the gate electrode Gj1 of the driving transistor of the jth pixel circuit and the gate electrode G(j+1)1 of the driving transistor of the j(j+1)th pixel circuit. For example, some of pixels may be disposed in such a manner that parasitic capacitance may occur between the anode of an organic light emitting diode of one pixel and the gate electrode of the driving transistor of a pixel circuit of another pixel. Other pixels may be disposed in such a manner that parasitic capacitance may not occur between the anode of the organic light emitting diode and the gate electrode of the driving transistor of the pixel circuit.

FIG. 5 illustrates a case where the gate electrode Gk1 of the driving transistor Tk1 of the kth pixel Pk entirely overlaps the anode ANODE(k+1) of the (k+1)th organic light emitting diode OLED(k+1). In another embodiment, the gate electrode Gk1 of the driving transistor Tk1 of the kth pixel Pk may partially overlap the anode ANODE(k+1) of the (k+1)th organic light emitting diode OLED(k+1). For example, part of the gate electrode Gk1 of the driving transistor Tk1 of the kth pixel Pk may overlap part of the anode ANODE(k+1) of the (k+1)th organic light emitting diode OLED(k+1).

As described above, according to one or more of the aforementioned embodiments, devices of an organic light emitting apparatus may be disposed in consideration of a parasitic capacitance that may occur between the devices.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display apparatus, comprising:

first and second pixels on a display region;

first and second scan lines connected to the first and second pixels respectively; and a gate driver to output a first scan signal and a second scan signal to the first and second scan lines respectively, wherein the first pixel includes a first pixel circuit and a first organic light emitting diode (OLED) and the second pixel includes a second pixel circuit and a second OLED, wherein each of the first and second pixel circuits includes a driving transistor to output driving current to an anode of a respective one of the first and second OLEDs, and wherein the anode of the second OLED at least partially overlaps a gate of a driving transistor of the first pixel circuit, wherein:

a voltage level of a gate of a driving transistor of the first pixel circuit is changed by a first variance according to a change in a voltage level of the anode of the second OLED at a scanning time by the second scan signal, the voltage level of the gate of the driving transistor of the first pixel circuit is changed by a second variance according to the change in the voltage level of the anode of the second OLED at an emitting time of the second OLED controlled by an emission control signal, and the second variance is at least partially compensated by the first variance.

2. The apparatus as claimed in claim 1, further comprising:

a controller to output a horizontal synchronization signal to the gate driver, wherein the gate driver is to output the first and second scan signals in synchronization with the horizontal synchronization signal, and wherein a scanning time of the first scan signal precedes a scanning time of the second scan signal.

3. The apparatus as claimed in claim 2, wherein the scanning time of the first scan signal precedes the scanning time of the second scan signal by a cycle of the horizontal synchronization signal.

4. The apparatus as claimed in claim 2, further comprising:

third and fourth pixels adjacent to the display region;

third and fourth scan lines respectively connected to the third and fourth pixels; and a second data line commonly connected to the third and fourth pixels, wherein the third pixel includes a third pixel circuit and a third OLED, wherein the fourth pixel includes a fourth pixel circuit and a fourth OLED, wherein each of the third and fourth pixel circuits includes a driving transistor to output a driving current to an anode of a respective one of the third and fourth OLEDs, wherein the anode of the third OLED is in a different region from gates of the driving transistors of the third and fourth pixel circuits in the display region, and wherein the anode of the fourth OLED is in a different region from gates of the driving transistors of the third and fourth pixel circuits in the display region.

5. The apparatus as claimed in claim 1, further comprising:

a first data line commonly connected to the first and second pixels; and a source driver synchronized with the first and second scan signals and to output a data signal to the first data line.

6. The apparatus as claimed in claim 5, wherein each of the first and second pixel circuits includes:

a switching transistor to transfer the data signal based on a respective one of the first and second scan signals; and a storage capacitor to charge a voltage corresponding to the transferred data signal, wherein the driving transistor is to output the driving current corresponding to the voltage charged in the storage capacitor to the anode of a respective one of the first and second OLEDs.

7. The apparatus as claimed in claim 6, wherein each of the first and second pixel circuits includes:

a compensation transistor to electrically connect a gate and a drain of the driving transistor based on a respective one of the first and second scan signals; and a gate initialization transistor to transfer an initialization voltage to the gate of the driving transistor based on a respective one of third and fourth scan signals, wherein a scanning time of the third scan signal precedes a scanning time by the first scan signal, and wherein a scanning time by the fourth scan signal precedes a scanning time by the second scan signal.

8. The apparatus as claimed in claim 7, further comprising:

a controller to output a horizontal synchronization signal to the gate driver, wherein the gate driver is to output the first and second scan signals in synchronization with the horizontal synchronization signal, wherein the scanning time of the third scan signal precedes a scanning time of the first scan signal by a cycle of the horizontal synchronization signal, and wherein the scanning time of the fourth scan signal precedes the scanning time of the second scan signal by the cycle of the horizontal synchronization signal.

9. The apparatus as claimed in claim 7, wherein each of the first and second pixel circuits includes:

an operation control transistor to be controlled by the emission control signal, the operation control transistor disposed between a driving voltage line and a source of the driving transistor; and an emission control transistor to be controlled by the emission control signal, the emission control transistor disposed between a drain of the driving transistor and the anode of a respective one of the first and second OLEDs, wherein the operation control transistor and the emission control transistor are to output a driving current generated by the driving transistor to the anode of the respective one of the first and second OLEDs based on the emission control signal.

10. The apparatus as claimed in claim 9, wherein each of the first and second pixel circuits includes:

an anode initialization transistor to transfer the initialization voltage to the anode of the respective one of first and second OLEDs based on a respective one of the first and second scan signals.

11. The apparatus as claimed in claim 10, wherein a time when a storage capacitor of the first pixel circuit is completely charged precedes a time when the initialization voltage is transferred to the anode of the second OLED by the anode initialization transistor of the second pixel circuit and the emitting time of the second OLED by the emission control transistor of the second pixel circuit.

12. The apparatus as claimed in claim 1, further comprising:

a third pixel on the display region, wherein the third pixel includes a third pixel circuit and a third OLED, wherein the third pixel circuit includes a driving transistor to output a driving current to an anode of the third OLED, and wherein the anode of the third OLED at least partially overlaps a gate of a driving transistor of the second pixel circuit.

13. An organic light emitting display apparatus, comprising:

first and second pixel regions on a display region;

first and second scan lines respectively connected to the first and second pixel regions; and a gate driver to respectively output a first scan signal and a second scan signal to the first and second scan lines, wherein the first pixel region includes a first pixel circuit and a first organic light emitting diode (OLED), wherein the second pixel region includes a second pixel circuit and a second OLED, wherein each of the first and second pixel circuits includes a driving transistor, wherein an anode of the first OLED at least partially overlaps a gate of a driving transistor of the first pixel circuit, wherein an anode of the second OLED at least partially overlaps the gate of the driving transistor of the second pixel circuit, wherein the second pixel circuit is to output a driving current to the anode of the first OLED, wherein a voltage level of a gate of a driving transistor of the first pixel circuit is changed by a first variance according to a change in a voltage level of the anode of the first OLED at a scanning time by the second scan signal, wherein the voltage level of the gate of the driving transistor of the first pixel circuit is changed by a second variance according to the change in the voltage level of the anode of the first OLED at an emitting time of the first OLED controlled by an emission control signal, and wherein the second variance is at least partially compensated by the first variance.

14. The apparatus as claimed in claim 13, further comprising:

a controller to output a horizontal synchronization signal to the gate driver, wherein the gate driver is to output the first and second scan signals in synchronization with the horizontal synchronization signal, and wherein a scanning time of the first scan signal precedes a scanning time of the second scan signal.

15. The apparatus as claimed in claim 14, wherein the scanning time of the first scan signal precedes the scanning time of the second scan signal by a cycle of the horizontal synchronization signal.

16. The apparatus as claimed in claim 14, further comprising:

a first data line commonly connected to the first and second pixels; and a source driver synchronized with the first and second scan signals and to output a data signal to the first data line, wherein each of the first and second pixel circuits includes:

a switching transistor to transfer the data signal based on a respective one of the first and second scan signals; and a storage capacitor to charging a voltage corresponding to the transferred data signal, wherein the driving transistor is to output the driving current corresponding to the voltage charged in the storage capacitor.

17. The apparatus as claimed in claim 16, further comprising:

a controller to output a horizontal synchronization signal to the gate driver, wherein the gate driver is to be synchronized with the horizontal synchronization signal and is to output the first and second scan signals, wherein each of the first and second pixel circuits includes:

a compensation transistor to electrically connect a gate and a drain of the driving transistor based on a respective one of the first and second scan signals; and a gate initialization transistor to transfer an initialization voltage to the gate of the driving transistor based on a respective one of the third and fourth scan signals, wherein a scanning time of the third scan signal precedes a scanning time of the first scan signal by a cycle of the horizontal synchronization signal, and wherein a scanning time of the fourth scan signal precedes a scanning time of the second scan signal by the cycle of the horizontal synchronization signal.

18. The apparatus as claimed in claim 17, wherein each of the first and second pixel circuits includes:

an operation control transistor to be controlled by the emission control signal, the operation control transistor disposed between a driving voltage line and a source of the driving transistor; and an emission control transistor to be controlled by the emission control signal, the emission control transistor disposed between a drain of the driving transistor and each of the anodes of the first and second OLEDs, wherein the operation control transistor and the emission control transistor are to output a driving current generated by the driving transistor based on the emission control signal.

19. The apparatus as claimed in claim 18, wherein the second pixel circuit includes:

an anode initialization transistor to transfer the initialization voltage to the anode of the first OLED based on the second scan signal, wherein a time when a storage capacitor of the first pixel circuit is completely charged precedes a time when the initialization voltage is transferred to the anode of the first OLED by the anode initialization transistor of the second pixel circuit and the emitting time of the first OLED by the emission control transistor of the second pixel circuit.

* * * * *